United States Patent [19]

Yoshimura et al.

[11] Patent Number: 4,951,836

[45] Date of Patent: Aug. 28, 1990

[54] EASY-OPEN CONTAINER

[75] Inventors: Kunitoshi Yoshimura, Omiya; Akira Nakata, Ageo; Hitoshi Terai, Kasukabe; Sakayu Iida, Iwatsuki, all of Japan

[73] Assignees: Hokkai Can Co., Ltd.; Kirin Brewery Co., Ltd., both of Tokyo, Japan

[21] Appl. No.: 421,117

[22] Filed: Oct. 13, 1989

[30] Foreign Application Priority Data

Oct. 13, 1988 [JP] Japan ..... 63-132873[U]

[51] Int. Cl.[5] ..... B65D 17/34

[52] U.S. Cl. ..... 220/271; 220/270; 220/276; 220/359

[58] Field of Search ..... 220/269, 270, 271, 276, 220/359; 215/256

[56] References Cited

U.S. PATENT DOCUMENTS 3,773,207 11/1973 Dokoupil et al. ..... 220/271 X
4,564,116 1/1986 Prohaska ..... 215/256
4,712,706 12/1987 Nakata et al. ..... 220/276

FOREIGN PATENT DOCUMENTS 61-119946 7/1986 Japan .
61-178364 11/1986 Japan .
61-273356 12/1986 Japan .
62-65934 4/1987 Japan .
62-69426 5/1987 Japan .
63-3966 1/1988 Japan .
63-42545 3/1988 Japan .

*Primary Examiner*—Stephen P. Garbe
*Assistant Examiner*—Nova Stucker

[57] ABSTRACT

An easy-open container includes a container barrel having an open end and a container end including a panel, a peripheral wall joined to and depending from a peripheral edge of the panel, and a pull tab joined to a lower edge of the peripheral wall. The peripheral wall is scored to provide a tear-off line joined to a side edge of the pull tab. The peripheral wall is fitted over the open end of the container barrel. An outer surface of the open end of the container barrel and an inner surface of the peripheral wall of the container end are bonded to each other through a bonded region. The tear-off line comprises a first continuous portion extending from the side edge of the pull tab through a bonded region of the peripheral wall above the pull tab into a non-bonded region of the peripheral wall above an upper edge of the bonded region, a second dotted-line portion joined to the first continuous portion and extending along the non-bonded region of the peripheral wall above the upper edge of the bonded region, and a third continuous portion joined to the second dotted-line portion and extending along the non-bonded region of the peripheral wall above the upper edge of the bonded region.

5 Claims, 4 Drawing Sheets

EASY-OPEN CONTAINER

BACKGROUND OF THE INVENTION

The present invention relates to an easy-open container which can easily be opened by tearing off a scored wall of a container end or cover.

There is known an easy-open container, as disclosed in Japanese Laid-Open Pat. Publication No. 60(1985)-193837, which has a container end or cover including a panel, a peripheral wall joined to and depending from the entire peripheral edge of the panel, and an end-opening pull tab attached to a lower edge of the peripheral wall. The peripheral wall is scored, i.e., cut to provide a tear-off line, substantially fully therearound, the tear-off line being joined to a side edge of the pull tab. The peripheral wall of the container end is fitted over an open end of a container barrel and bonded thereto to seal off the contents of the container barrel.

However, the disclosed easy-open container is disadvantageous in that the contents may flow out when the container barrel is opened by tearing off the scored container end along the tear-off line.

If the easy-open container contains a carbonated drink such as beer, a carbonated beverage, or the like, since the internal pressure in the container barrel is high, the container end is torn quickly continuously along the tear-off line at an initial phase of the container opening process, with the result that sniffing, i.e., drawing pressurized air out of the container, may not sufficiently be effected.

When the contents are not sufficiently cooled and there is a high pressure buildup in the container, a large sniff is produced under the high internal pressure when the container is opened. Furthermore, when the pull tab is pulled, the container barrel may be shaken, and the contents may be forced out because of an abrupt release of the internal pressure.

At the time the container end is torn off along the tear-off line, the bonded peripheral wall of the container end must also be peeled off simultaneously. Therefore, the container barrel and the tub gripped by the user are relatively moved away from each other with a relatively strong manual force. As the container end is progressively torn along the tear-off line, the peripheral wall thereof joined to the pull tab is peeled off the container barrel, and the distance between the container barrel and the pull tab is increased. Since the starting and terminal ends of tear-off line are not connected to each other, even when the container end is torn to the end of the tear-off line, a portion of the peripheral wall which extends between the starting and terminal ends of the tear-off line remains bonded to the container barrel. The container end can fully be opened or removed from the container barrel only when the remaining bonded portion of the peripheral wall is completely peeled off. When the remaining bonded portion of the peripheral wall is peeled off, the force which has been applied to the pull tab that is largely spaced from the container barrel is abruptly released. At this time, the container barrel may be shaken and the contents thereof may flow out.

SUMMARY OF THE INVENTION

It is an object of the present invention to provide an easy-open container which prevents contents from flowing out of a container barrel when a scored container end or cover is torn off along a tear-off line.

Another object of the present invention is to provide an easy-open container which allows reliable sniffing and prevents contents from flowing out during an initial phase of a container opening process especially when the internal pressure in the container is high.

Still another object of the present invention is to provide an easy-open container including a scored container end or cover which can stably be torn off along a tear-off line without letting contents flow out of a container barrel.

According to the present invention, there is provided an easy-open container comprising a container barrel having an open end, a container end including a panel, a peripheral wall joined to and depending from a peripheral edge of the panel, and a pull tab joined to a lower edge of the peripheral wall, the peripheral wall being scored to provide a tear-off line joined to a side edge of the pull tab, the peripheral wall being fitted over the open end of the container barrel, and a bonded region by which an outer surface of the open end of the container barrel and an inner surface of the peripheral wall of the container end are bonded to each other, the tear-off line comprising a first continuous portion extending from the side edge of the pull tab through a bonded region of the peripheral wall above the pull tab into a non-bonded region of the peripheral wall above an upper edge of the bonded region, a second dotted-line portion joined to the first continuous portion and extending along the non-bonded region of the peripheral wall above the upper edge of the bonded region, and a third continuous portion joined to the second dotted-line portion and extending along the non-bonded region of the peripheral wall above the upper edge of the bonded region.

When the pull tab is gripped and pulled to tear the peripheral wall in an initial opening phase, since the peripheral wall is not easily torn along the second dotted-line portion, the tearing process is slowed down or interrupted at the second dotted-line portion, and hence the initial opening phase is not abruptly carried out. At this time, the interior and exterior of the container barrel communicate with each other through a limited slot defined in and along the second portion in the non-bonded region of the peripheral wall. A gas under pressure gradually leaks from within the container barrel through the limited slot, so that the container barrel can sufficiently sniff and the contents will not flow out.

The third continuous portion of the tear-off line includes a tear-off line segment extending from the non-bonded region of the peripheral wall into the bonded region thereof across the upper edge of the bonded region and back into the non-bonded region above the upper edge of the bonded region, the first and third continuous portions having starting and terminal ends, respectively, which vertically overlap each other and are vertically spaced from each other.

When the peripheral wall is torn from the first portion to the terminal end of the third portion, a portion of the peripheral wall remains bonded to the container barrel at the third portion of the tear-off line.

The peripheral wall between the starting and terminal ends of the first and third continuous portions of the tear-off line remains bonded to the container barrel, and the open end of the container barrel is covered with the panel. Since the open end of the container barrel is covered with the barrel, the contents are prevented from flowing out of the container barrel. Then, when the pull tab is further pulled to peel off the peripheral wall between the starting and terminal ends of the first and third tear-off line portions, the container end is swung upwardly about a bonded portion of the peripheral wall along the third tear-off line portion. Therefore, the container barrel is prevented from being shaken, and the contents do not flow out of the container barrel.

The starting end of the first continuous portion is positioned in confronting relation to a notch defined in the side edge of the pull tab.

This arrangement allows the peripheral wall to start to be torn reliably along the first tear-off line portion.

The container end comprises a thin metal sheet and a thermoplastic resin layer coated on an outer surface of the thin metal sheet, the tear-off line being defined by partly removing the thermoplastic resin layer.

With this arrangement, the fingers of the user will not be injured even when they touch the torn edges of the peripheral wall.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

FIGS. 1 through 4 show an easy-open container according to the present invention.

Figure 2:
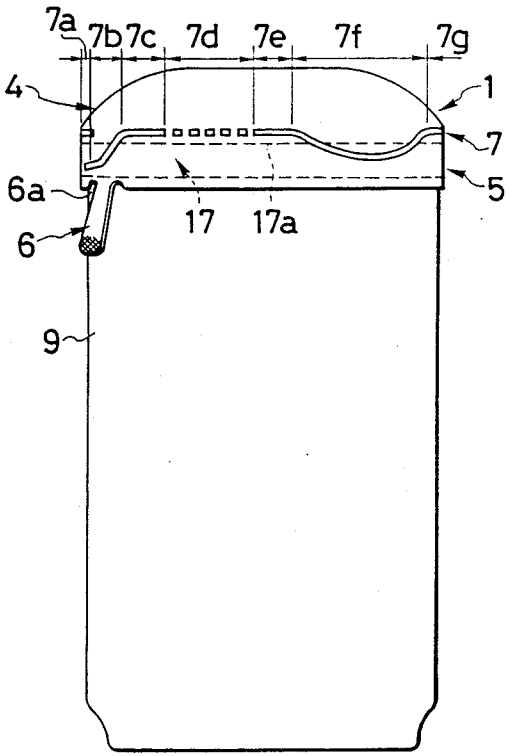
FIG. 2 is a righthand side elevational view of the easy-open container shown in FIG. 1.
Figure 1:
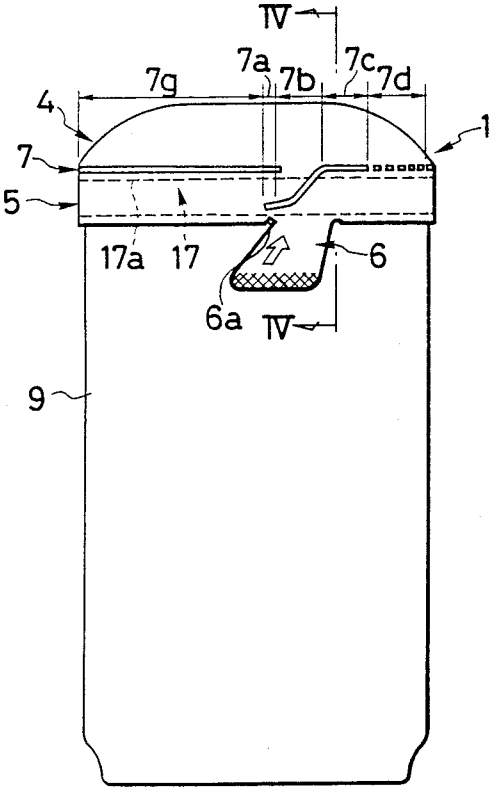
FIG. 1 is a front elevational view of an easy-open container according to the present invention.
Figure 4:
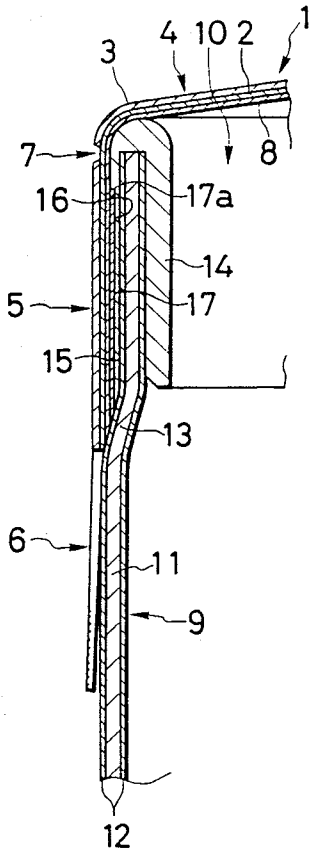
FIG. 4 is an enlarged fragmentary cross-sectional view taken along line IV—IV of FIG. 1.
Figure 3:
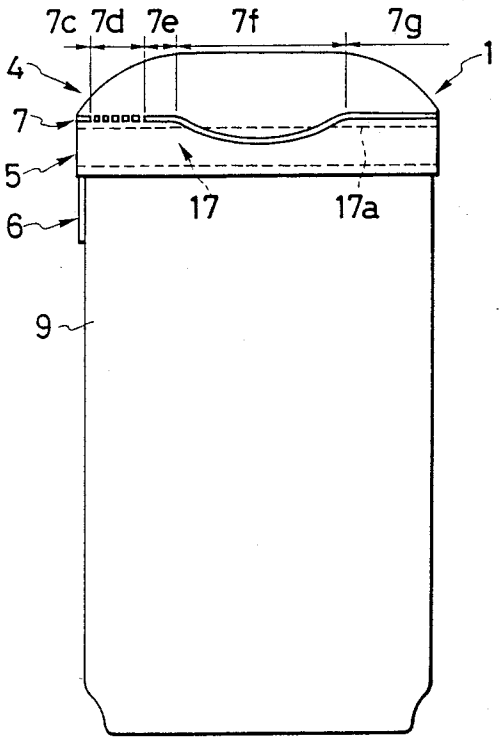
FIG. 3 is a rear elevational view of the easy-open container shown in FIG. 1.

As shown in FIG. 4, a container end or cover 1 comprises a metal foil 2 of tin-free steel, aluminum, or the like, and a thermoplastic resin coating 3 of polypropylene, polyethylene, or the like covering the outer surface of the metal foil 2. The container end 1 includes a panel 4 and a tubular peripheral wall 5 (see also FIGS. 1, 2, and 3) depending from the entire peripheral edge of the panel 4. As illustrated in FIG. 1, a pull tab 6 for removing the container end 1 is integrally formed with the peripheral wall 5 at a lower edge thereof. The peripheral wall 5 is scored substantially fully therearound to provide a tear-off line 7 extending from a side edge of the pull tab 6 on the lower edge of the peripheral wall 5.

The inner surface of the container end 1 is coated with a hot-melt adhesive resin layer 8 of polyolefin, polyamide, polyester, or the like.

As illustrated in FIG. 4, a container barrel 9 includes a two-piece bottomed cylindrical barrel portion 11 made of aluminum and having an open end 10, with can coating layers 12 being coated on the inner and outer surfaces of the cylindrical barrel portion 11. Instead, the container barrel 9 may comprise a three-piece bottomed cylindrical portion made of tin and tin-free steel, or may comprise a container made of a composite material or glass.

The container barrel 9 has, at the open end 10, a necked-in portion 13 smaller in diameter than the cylindrical portion 11. The open end 10 is covered with a cylindrical stiffening member 14 made of a hot-melt adhesive resin and having a substantially U-shaped cross section, the stiffening member 14 extending fully around the open end 10.

With the container barrel 9 fully closed by the container end 1, an inner surface 16 of the peripheral wall 5 of the container end 1 is fitted over an outer surface 15 of the open end 10 with the stiffening member 14 interposed therebetween. The hot-melt adhesive resin layer 8 on the inner surface of the peripheral wall 5 and the stiffening member 14 are melted and bonded to each other fully along their peripheral surfaces, thus forming a bonded region 17 between the peripheral wall 5 and the container barrel 9.

The tear-off line 7 is produced by removing the thermoplastic resin coating 3 from the outer surface of the peripheral wall 5 by applying a laser beam, for example, to the coating 3 along a desired pattern.

The tear-off line 7 comprises three portions. The first portion includes a segment *7a* (FIGS. 1, 2, and 5) extending across an extension of, and hence confronting, a notch *6a* defined in a side edge of the pull tab 6, a continuous segment *7b* joined to the first segment *7a* and extending across a region above the pull tab 6, the second continuous segment *7b* extending into a non-bonded region above an upper edge *17a* of the bonded region 17, and a segment *7c* joined to the segment *7b* and extending above the upper edge *17a* in a peripheral direction of the peripheral wall 5. The peripheral wall 5 is torn along the segment *7c* during an initial phase of the container opening process.

The second portion comprises a dotted-line segment *7d* extending peripherally from the segment *7c*.

The third portion comprises a segment *7e* extending peripherally from the segment *7d*, a segment *7f* connected to the segment *7e* and extending arcuately into the bonded region 17 in the peripheral wall 5 remote from the pull tab 6 and back into the non-bonded region above the upper edge *17a* of the bonded region 17, and a segment *7g* joined to the segment *7f* and extending peripherally along the peripheral wall 5 above the upper edge *17a* into a region near the side edge of the pull tab 6.

Figure 5:
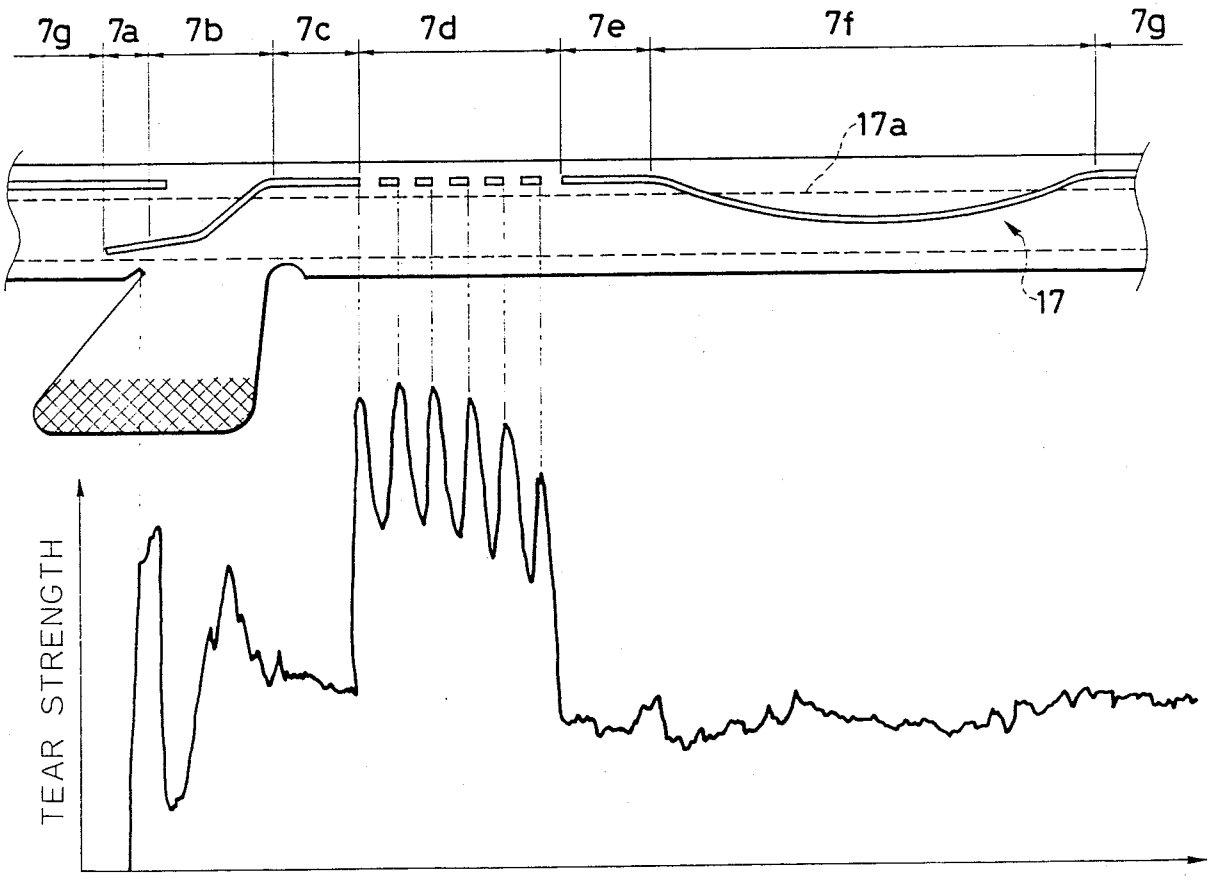
FIG. 5 is a diagram illustrating how the tear strength needed to open a container barrel varies as a container end is progressively torn along a tear-off line.

As shown in FIGS. 1 and 5, the starting end of the tear-off line segment *7a* and the terminal end of the tear-off line segment *7g* vertically overlap each other, but are vertically spaced from, and hence not connected to, each other.

A process of opening the container barrel 9 which is filled with contents under a high internal pressure will be described also with reference to FIG. 5, which shows how the tear strength needed to open the container barrel 9 varies as the opening process progresses.

First, the pull tab 6 is gripped and pulled obliquely upwardly in the direction indicated by the arrow. The peripheral wall 5 is torn from the notch *6a* in its side edge and then into the tear-off line segment *7a*. At this time, the tear strength is increased as shown in FIG. 5.

The tear strength is then lowered when the peripheral wall 5 starts being torn along the tear-off line segment *7b*, and increased again as the peripheral wall 5 is progressively torn along the tear-off line segment 7*b* up to the tear-off line segment 7*c*.

When the peripheral wall 5 is torn along the dotted tear-off line segment 7*d*, the tear strength is increased further. The tearing-off of the peripheral wall 5 at this time is slowed down or interrupted.

In order to tear the peripheral wall 5 along the tear-off line segment 7*d* up to the tear-off line segment 7*e*, therefore, the pull tab 6 must be pulled again. While the pulling of the pull tab 6 is being interrupted or slowed down, since the interior of the container barrel 9 has already been in communication with the exterior thereof through the tear-off line segment 7*c* which has been broken, the gas in the container barrel 9 is gradually released under pressure through the limited slit formed on and along the tear-off line segment 7*c*, thus allowing the container barrel 9 to sniff.

During this initial opening phase, even if the container barrel 9 is shaken, the contents are only allowed to flow out through the limited slit in and along the tear-off line segment 7*c*.

When the peripheral wall 5 is torn along the dotted tear-off line segment 7*d*, the tear strength is repeatedly varied. However, the peripheral wall 5 is torn smoothly and reliably along the dotted tear-off segment 7*d*, after which the peripheral wall 5 starts being torn along the tear-off line segment 7*e*. Then, the peripheral wall 5 is torn along the tear-off line segment 7*e* and thereafter along the tear-off lines 7*f* and 7*g*.

Figure 6:
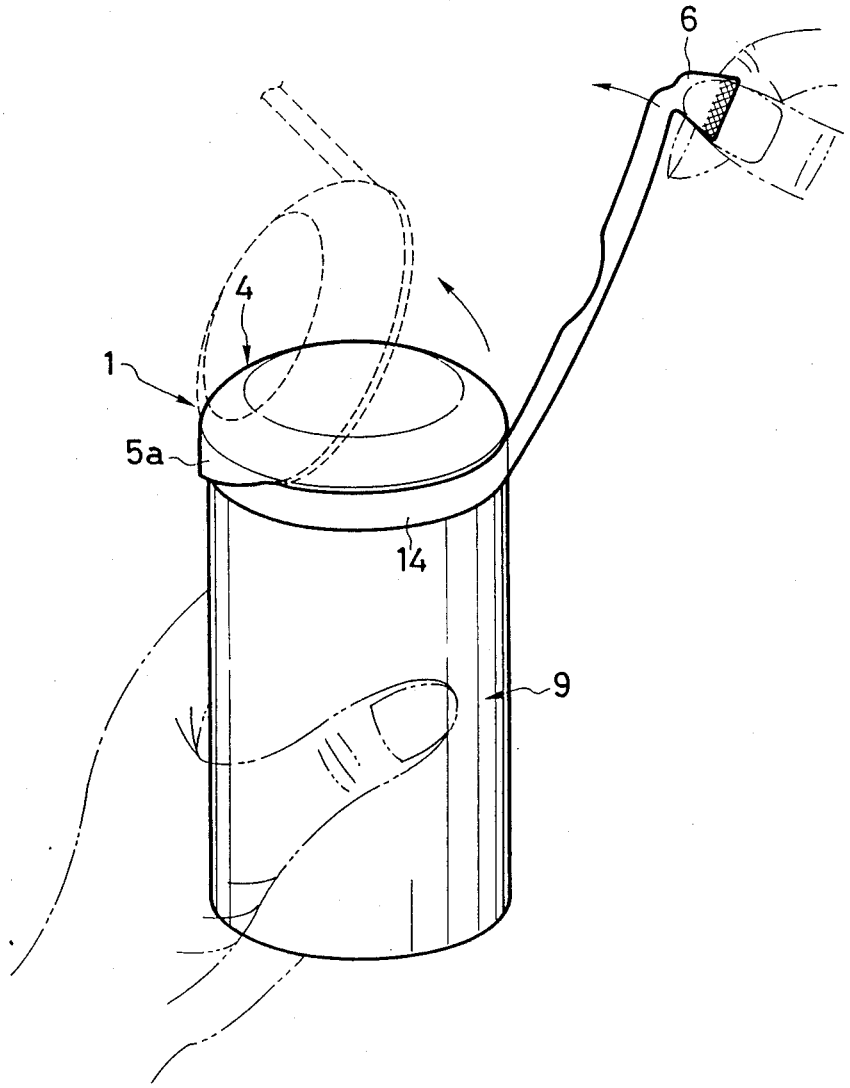
FIG. 6 is a perspective view showing the manner in which the easy-open container is manually opened.

When the tearing of the peripheral wall 5 along the tear-off line segment 7*g* is finished, since the terminal end of the tear-off line segment 7*g* is not connected to the starting end of the tear-off line segment 7*a*, the peripheral wall 5 between these ends of the segments 7*g*, 7*a* remains joined to the panel 4. To open the container barrel 9 completely, the pull tab 6 is pulled upwardly toward the panel 4 as indicated by the arrow in FIG. 6. At this time, a portion 5*a* of the peripheral wall 5 above the tear-off line segment 7*f* remains bonded to the container barrel 9 at a diametrically opposite position remote from the pull tab 6. While the pull tab 6 is being pulled upwardly, the panel 4 is swung upwardly about the bonded portion 5*a*, thus removing the container end 1 from the container barrel 9 to fully open the container barrel 9.

In this final opening phase, the container end 1 and the container barrel 9 can be separated from each other by a small uplifting force applied to the pull tab 6. Accordingly, the container barrel 9 does not suffer shaking movements which would otherwise be caused when the force applied to the container barrel 9 is abruptly released. As a consequence, the contents of the container barrel 9 are prevented from flowing out.

Even when the peripheral wall 5 is torn all the way along the tear-off line 7, the panel 4 still covers the open end of the container barrel 9 until the container end 1 is separated from the container barrel 9. Therefore, the contents are also prevented from flowing out even when the container barrel 9 is shaken while it is being opened.

The tear-off line segment 7*c* should preferably be relatively short. If it were unduly long, the region of the peripheral wall 5 which is torn open during the initial opening phase would be large, resulting in a large sniff due to abrupt extensive communication between the interior and exterior of the container barrel 9.

While the container end 1 is constructed of the metal foil 2 covered with the thermoplastic resin layers 3, 8, it may be a metal container end of aluminum or the like.

Although a certain preferred embodiment has been shown and described, it should be understood that many changes and modifications may be made therein without departing from the scope of the appended claims.

What is claimed is:

1. An easy-open container comprising:

a container barrel having an open end;

a container end including a panel, a peripheral wall joined to and depending from a peripheral edge of said panel, and a pull tab joined to a lower edge of said peripheral wall, said peripheral wall being scored to provide a tear-off line joined to a side edge of said pull tab, said peripheral wall being fitted over the open end of said container barrel;

a bonded region by which an outer surface of said open end of the container barrel and an inner surface of said peripheral wall of the container end are bonded to each other; and said tear-off line comprising a first continuous portion extending from the side edge of said pull tab through a bonded region of the peripheral wall above said pull tab into a non-bonded region of the peripheral wall above an upper edge of said bonded region, a second dotted-line portion joined to said first continuous portion and extending along the non-bonded region of the peripheral wall above the upper edge of said bonded region, and a third continuous portion joined to said second dotted-line portion and extending along the non-bonded region of the peripheral wall above the upper edge of said bonded region.

2. An easy-open container according to claim 1, wherein said third continuous portion of the tear-off line includes a tear-off line segment extending from the non-bonded region of the peripheral wall into the bonded region thereof across the upper edge of said bonded region and back into said non-bonded region above said upper edge of the bonded region, said first and second continuous portions having starting and terminal ends, respectively, which vertically overlap each other and are vertically spaced from each other.

3. An easy-open container according to claim 1, wherein said starting end of the first continuous portion is positioned in confronting relation to a notch defined in the side edge of said pull tab.

4. An easy-open container according to claim 1, wherein said container end comprises a thin metal sheet and a thermoplastic resin layer coated on an outer surface of said thin metal sheet, said tear-off line being defined by partly removing said thermoplastic resin layer.

5. An easy-open container comprising:

a container barrel having an open end;

a container end including a panel, a peripheral wall joined to and depending from a peripheral edge of said panel, and a pull tab joined to a lower edge of said peripheral wall, said peripheral wall being scored to provide a tear-off line joined to a side edge of said pull tab, said peripheral wall being fitted over the open end of said container barrel;

a bonded region by which an outer surface of said open end of the container barrel and an inner surface of said peripheral wall of the container end are bonded to each other; and said tear-off line comprising a continuous portion extending from the side edge of said pull tab through a bonded region of the peripheral wall above said pull tab into a non-bonded region of the peripheral wall above an upper edge of said bonded region, and another continuous portion extending along the non-bonded region of the peripheral wall above the upper edge of said bonded region, said portions of the tear-off line being disconnected from each other in the non-bonded region of the peripheral wall above the upper edge of said bonded region.

* * * * *